US005331726A

United States Patent [19]

Suh

[11] Patent Number: 5,331,726

[45] Date of Patent: Jul. 26, 1994

[54] BAND LINK WITH A SAFETY DEVICE

[76] Inventor: Sam Am Suh, 245-1 Yong Sun 4 Dong, Yongdoku, Pusan, Rep. of Korea

[21] Appl. No.: 93,966

[22] Filed: Jul. 21, 1993

[30] Foreign Application Priority Data

Dec. 3, 1992 [KR] Rep. of Korea ..... 92-24520

[51] Int. Cl.[5] ..... A44B 11/00

[52] U.S. Cl. ..... 24/625; 24/196; 24/618

[58] Field of Search ..... 24/625, 616, 615, 618, 24/575, 200, 196, 183, 600.5, 600.6

[56] References Cited

U.S. PATENT DOCUMENTS

| | | | |
|---|---|---|---|
| 2,870,509 | 1/1959 | Gaylord | 24/600.6 |
| 2,988,797 | 6/1961 | Gaylord | 24/600.5 |
| 4,502,188 | 3/1985 | Kohli | 24/618 |
| 4,577,377 | 3/1986 | Kasai | 24/625 |
| 5,075,932 | 12/1991 | Hunt et al. | 24/196 |

*Primary Examiner*—Victor N. Sakran

[57] ABSTRACT

The present invention relates to a band link with a safety device for use in adjusting and fixing a shoulder band or a waist band of various bags or rucksacks wherein after the band is suitably adjusted according to the physique of the user, the locking piece connected at the side of the band link is moved and fixed toward the band-controlling toothed side, so the band is not disengaged and is fixed as it stands even if excessive force or shock is exerted on the band link.

3 Claims, 1 Drawing Sheet

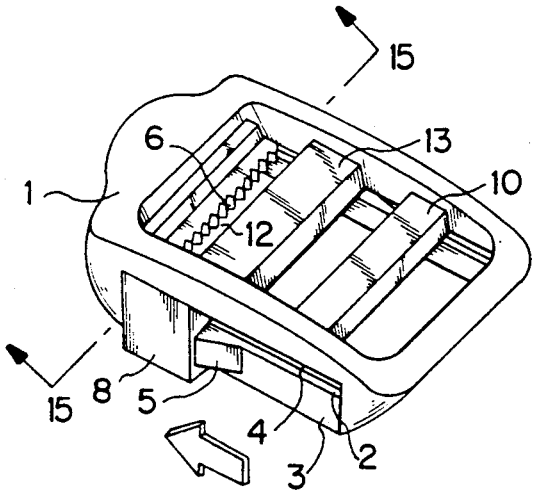
FIG. 1
FIG. 2(A)
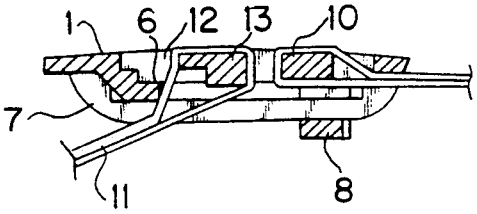
FIG. 2(B)
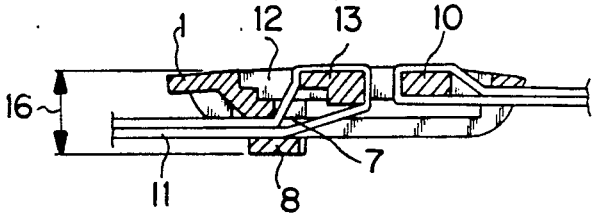
FIG. 3
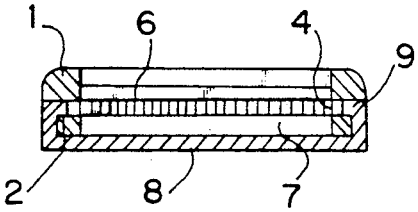
FIG. 4
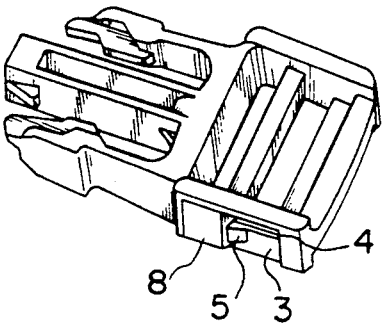

BAND LINK WITH A SAFETY DEVICE

FIELD OF THE INVENTION

The present invention generally relates to a fastener for use in adjusting and fixing a shoulder band or a waist band of a rucksack, a waist sack, a student book bag and the like and more particularly to a band link with a safety device to prevent the band from slipping off the band link in use.

BACKGROUND OF THE INVENTION

With conventional band links, a user adjusts the length of the band using the band link. However, conventional band links as described above include several disadvantages in that the band is not well secured and may slip from the band link if some shock or force is exerted on the band link after using. Thus, the user is required to inspect the band and the band links. In addition, the thickness of the folded band portion is thicker than that of the controlling piece of the band link or buckle. As a result, the band portion will protrudes above the surface of the band links. An example of a conventional band link partially ameliorating such defects is disclosed in Korean Utility Model Patent Application No. 92-1278 entitled "Band link With A Safety Device." The band link disclosed there includes some of the same inherent defects as other conventional devices in that if the band is inserted in the band link and then locked by a locking piece it may not loosen, but its thickness increases with use of a band-inserting bar in the locking piece. Further, because the locking piece is separately assembled with the band link, the separate pieces may be lost or damaged by mistake in use.

SUMMARY OF THE INVENTION

It is accordingly a primary object of the present invention to provide a band link with a safety device that overcomes the foregoing problems associated with conventional devices.

Another object of the present invention is to provide a band link with a safety device in which the locking piece is integrally and operatively connected to the band link or buckle and the thickness of the folded portion of the band as held within the band link is minimized to produce an improved aesthetic outward appearance.

The foregoing and other objects as well as advantages of the present invention will become clear by the following description of the invention with reference to the accompanying drawings.

BRIEF DESCRIPTION OF THE DRAWINGS

FIG. 1 is a perspective view of the band link with a safety device according to the present invention;

FIG. 2A is a cross-sectional view of the band link with a safety device according to the present invention wherein a band is inserted in the band link showing its condition before a locking piece is locked;

FIG. 2B is a cross-sectional view of the band link with a safety device according to the present invention wherein a band is inserted in the band link showing the condition of the link after a locking piece is locked;

FIG. 3 is a cross-sectional view taken along the line 15—15 of FIG. 1; and FIG. 4 is a perspective view of another embodiment according to the present invention.

DETAILED DESCRIPTION OF THE PREFERRED EMBODIMENTS

The preferred embodiment of a band link with a safety device according to the present invention will hereinafter be described with reference to FIGS. 1–4.

With reference to FIG. 1, the bond link with a safety device according to the present invention mainly includes a band link 1 and a locking piece 8. A pair of working guide grooves 3 having a stepped jaw 2 and a guide hole 4 are formed along two opposing outside walls 1 of the band link. A fixing projection 5 is formed around the midpoint of each working guide groove 3. A part of a band-controlling toothed side 6 is formed having a width which is narrower than the longitudinal width of the band link 1 thus defining a recessed space 7 between the band-controlling toothed side 6 and the locking piece 8 (as discussed below). An inserting jaw 9 of the locking piece 8 is disposed into the guide hole 4 of the band link 1 for controlling movement of the locking piece 8 along the guide groove 3.

According to the present invention, bands of various bags or rucksacks may be used with the band link 1. One end of the band 11 fixed to the bag, rucksack or the like, is inserted in the band link, and fixed around the hanging piece 10. The other end of the band 11 is inserted but not fixed in the band link 1 to allow for adjustment of the length of the band according to the physique of the user. The band 11 is inserted from underneath the band link, in the space 12 in front of the band-controlling toothed side 6, turned around the fixing piece 13 and pulled out into the recessed space 7. After adjusting the length of the band, the locking piece 8 is pulled forward to basis the band 11 against the opposite side of the band-controlling toothed side 6 as shown in FIG. 2(B). The inserting jaw 9 of the locking piece 8 moves along the guide hole 4. Thereby the locking piece 8 is fixed in the working guide groove 3 between the band-controlling toothed side 6 of band link 1 and the fixing projection 5.

When fixed, the locking piece 8 as positioned in the recessed space 7 below the band-controlling toothed side 6 holds the band. Once the locking piece 8 is in position, it is held in place by the fixing projection 5.

The thickness of the locking piece 8 is formed equally with that of the stepped jaw 2 of the working guide groove 3 in the band link 1. Thus, the locking piece 8 will have the same dimension as that of the band link 1 so as not to project beyond the surface of the link. Therefore, it is also possible to conveniently apply a safety device to the buckle of a rucksack or student book bag.

A second preferred embodiment of applicant's band link 1 is shown in FIG. 4. There, the band link 1 includes a portion with a male connection for insertion in a female receptacle (not shown). The band holding section of the band link is similar to that described above. With this embodiment, the band may remain locked in an adjusted position even if the user desires to disconnect the band for removing the rucksack or student book bag. This particular embodiment is particularly convenient when the band is adjusted to fit tightly around the user.

Thus, in the case of the band link with a safety device according to the present invention, the locking piece 8 functions as the safety device when the band is fixed at a certain length so as to secure the adjusted band. Therefore, the band link can be used at a fixed position at all times for a long time even if some force or shock is exerted on the band link in use.

The above description is given on the preferred embodiment of the invention, however it will be apparent that modifications and variations could be effected by one skilled in the art without departing from the spirit or scope of the novel concepts of the invention as defined in the appended claim.

What is claimed is:

1. A band link with a safety device for securing a flexible band, comprising:

a body for receiving the band having a band-controlling toothed side, said body having a pair of working guide grooves, each groove including a stepped jaw and a guide hole;

a locking piece inserted into said guide holes for movement to a holding position for securing said flexible band against the band-controlling tooth side;

a fixing projection formed in each of the working guide grooves for fixing said locking piece in the holding position;

wherein in the holding position, the band is secured against the body in a recessed space formed below the band-controlling toothed side and the locking piece.

2. A band link for securing a flexible band, comprising:

a body having a band-controlling element;

means for supporting the band within said body, said supporting means including a fixed support suspended between the interior walls of an aperture in said body such that the band is positioned around the fixed support and folded onto itself; and means for securing the band, said securing means including a locking piece slidably connected to said body for holding the folded band against the band-controlling element in a recessed space between the locking piece and the body such that the folded band does not extend beyond the top surface of said body or the bottom surface of said locking piece.

3. A band link for securing a flexible band as recited in claim 2, wherein said body further comprises a pair of working guide grooves for receiving said locking piece and a fixing projection disposed within each of said guide grooves for fixing said locking piece in position for holding the folded band.

* * * * *